US009614354B2

(12) United States Patent
Yoshida et al.

(10) Patent No.: US 9,614,354 B2
(45) Date of Patent: Apr. 4, 2017

(54) SPARK PLUG

(71) Applicant: NGK SPARK PLUG CO., LTD., Nagoya-shi, Aichi (JP)

(72) Inventors: Haruki Yoshida, Tajimi (JP); Jumpei Kita, Nagoya (JP); Yoshitomo Iwasaki, Komaki (JP); Toshitaka Honda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/913,772

(22) PCT Filed: Jun. 2, 2014

(86) PCT No.: PCT/JP2014/002900
§ 371 (c)(1),
(2) Date: Feb. 23, 2016

(87) PCT Pub. No.: WO2015/118581
PCT Pub. Date: Aug. 13, 2015

(65) Prior Publication Data

US 2016/0204579 A1 Jul. 14, 2016

(30) Foreign Application Priority Data

Feb. 7, 2014 (JP) ..... 2014-022891

(51) Int. Cl.
*H01T 13/04* (2006.01)
*H01T 13/20* (2006.01)
(Continued)

(52) U.S. Cl.
CPC ..... *H01T 13/41* (2013.01); *H01T 13/05* (2013.01); *H01T 13/20* (2013.01)

(58) Field of Classification Search
CPC ..... H01T 13/41; H01T 13/05; H01T 13/20
See application file for complete search history.

(56) References Cited

U.S. PATENT DOCUMENTS 5,304,894 A * 4/1994 Stimson ..... C03C 8/14 252/507
2011/0133626 A1 6/2011 Shibata et al. ..... 313/141
2013/0264939 A1 10/2013 Fukushima et al. ..... 315/58

FOREIGN PATENT DOCUMENTS

CN 103262369 A 9/1990 ..... H01C 7/00
CN 103262369 A 8/2013 ..... H01T 13/20
(Continued)

OTHER PUBLICATIONS

International Search Report issued in corresponding International Patent Application No. PCT/JP2014/002900, dated Jul. 1, 2014.
(Continued)

*Primary Examiner* — Donald Raleigh
(74) *Attorney, Agent, or Firm* — Kusner & Jaffe

(57) ABSTRACT

A resistor element of a spark plug containing $ZrO_2$, wherein a target region is defined by a rectangular region where the size in the direction perpendicular to an axial line is 1800 μm and the size in the direction of the axial line is 2400 μm. In the case where the target region is divided into a plurality of square regions having lengths of 200 μm on a side, a transverse line-shaped region is defined by a region in a line shape that is constituted of nine square regions arranged in the direction perpendicular to the axial line. A first type region is defined by the square region where a proportion of an area of $ZrO_2$ is 25% or more, and a second type region is defined by the square region where a proportion of an area of $ZrO_2$ is less than 25%.

9 Claims, 2 Drawing Sheets

(51) Int. Cl.
*H01T 13/41* (2006.01)
*H01T 13/05* (2006.01)

(56) References Cited

FOREIGN PATENT DOCUMENTS

| | | | | |
|---|---|---|---|---|
| EP | 0170975 | A1 | 2/1986 | ..... H01T 13/41 |
| JP | 61/39386 | A | 2/1986 | ..... H01T 13/20 |
| JP | 2005/327743 | A | 11/2005 | ..... H01C 7/00 |
| WO | WO 2009/154070 | A1 | 12/2009 | ..... H01C 13/003 |

OTHER PUBLICATIONS

Office Action received in corresponding Chinese Patent Application No. 201480047808.3, dated Jul. 3, 2016 (English translation provided).

* cited by examiner

SPARK PLUG

RELATED APPLICATIONS

This application is a National Stage of International Application No. PCT/JP2014/002900 filed Jun. 2, 2014, which claims the benefit of Japanese Patent Application No. 2014-022891, filed Feb. 7, 2014.

FIELD OF THE INVENTION

The present invention relates to a spark plug.

BACKGROUND OF THE INVENTION

Conventionally, a spark plug is used in an internal combustion engine. To reduce the radio wave noise generated by ignition, there is proposed a technique that arranges a resistor element between a center electrode and a terminal metal fitting.

Nowadays, further improvements in electrical noise performance and in durability are required due to a high-power engine or similar reason.

The main advantage of the present invention is to improve the suppression performance of the radio wave noise and the service life of the resistor element.

SUMMARY OF THE INVENTION

The present invention has been conceived to solve at least a part of the above-mentioned problems, and can be realized as the following application examples.

Application Example 1

In accordance with a first aspect of the present invention, there is provided a spark plug that includes an insulator, a center electrode, a terminal metal fitting, and a connecting portion. The insulator has a through hole extending in a direction of an axial line. The center electrode is at least partially inserted into a front end side of the through hole. The terminal metal fitting is at least partially inserted into a rear end side of the through hole. The connecting portion electrically connects the center electrode and the terminal metal fitting together within the through hole. The connecting portion includes a resistor element. The resistor element includes an aggregate, a filler containing $ZrO_2$, and carbons. In a cross section including the axial line of the resistor element, a center line is defined by the axial line. A target region is defined by a rectangular region where a size in a direction perpendicular to the axial line is 1800 μm and a size in a direction of the axial line is 2400 μm. A transverse line-shaped region is defined by a region in a line shape that is constituted of nine square regions arranged in the direction perpendicular to the axial line in the case where the target region is divided into a plurality of square regions having lengths of 200 μm on a side. A first type region is defined by the square region where a proportion of an area of $ZrO_2$ is 25% or more. A second type region is defined by the square region where a proportion of an area of $ZrO_2$ is less than 25%. In this case, a total number of the transverse line-shaped regions including two or more of the first type regions is equal to or more than 5.

With this configuration, ensuring a proper state within the resistor element allows improving both the suppression performance of radio wave noise and the service life of the resistor element.

Application Example 2

In accordance with a second aspect of the present invention, there is provided a spark plug according to the application example 1, wherein a total number of the transverse line-shaped regions including two or more of the consecutive first type regions is equal to or more than 5.

With this configuration, ensuring a proper state within the resistor element allows improving both the suppression performance of radio wave noise and the service life of the resistor element.

Application Example 3

In accordance with a third aspect of the present invention, there is provided a the spark plug according to the application example 1 or 2, wherein the filler contains $TiO_2$, and a weight proportion of Ti to Zr in the resistor element is equal to or more than 0.05 and equal to or less than 6.

With this configuration, ensuring a proper weight proportion of Ti to Zr in the filler allows improving both the suppression performance of radio wave noise and the service life of the resistor element.

Application Example 4

In accordance with a fourth aspect of the present invention, there is provided a spark plug according to any one of the application examples 1 to 3, wherein, in a cross section perpendicular to the axial line in the resistor element, a minimum value of an outer diameter of a portion in contact with an inner peripheral surface of the insulator over a whole circumference is equal to or less than 3.5 mm.

This configuration allows improving both the suppression performance of radio wave noise and the service life of the resistor element in the case where the resistor element with the outer diameter of 3.5 mm or less is used.

Application Example 5

In accordance with a fifth aspect of the present invention, there is provided a spark plug according to the application example 4, wherein the minimum value of the outer diameter is equal to or less than 2.9 mm.

This configuration allows improving both the suppression performance of radio wave noise and the service life of the resistor element in the case where the resistor element with the outer diameter of 2.9 mm or less is used.

Application Example 6

In accordance with a sixth aspect of the present invention, there is provided a spark plug according to any one of the application examples 1 to 5, wherein a distance in the axial line between a rear end of the center electrode and a front end of the terminal metal fitting is equal to or more than 15 mm.

This configuration allows improving both the suppression performance of radio wave noise and the service life of the resistor element in the case where the resistor element is arranged between the center electrode and the terminal metal fitting that are arranged at a distance of 15 mm or more from each other.

Application Example 7

In accordance with a seventh aspect of the present invention, there is provided a spark plug according to any one of the application examples 1 to 6, wherein a longitudinal line-shaped region is defined by a line-shaped region that is constituted of 12 of the square regions arranged in a direction parallel to the axial line. A longitudinal maximum consecutive number is defined by a maximum value of a consecutive number of the first type regions in one longitudinal line-shaped region. In this case, an average value of the longitudinal maximum consecutive number in nine longitudinal line-shaped regions included in the target region is equal to or less than 5.0.

This configuration allows further improving the suppression performance of radio wave noise.

Application Example 8

In accordance with an eighth aspect of the present invention, there is provided a spark plug according to any one of the application examples 1 to 7, wherein a total number of the transverse line-shaped regions including two or more of the consecutive first type regions is equal to or more than 7.

This configuration allows further improving the service life of the resistor element.

Application Example 9

In accordance with a ninth aspect of the present invention, there is provided a spark plug according to any one of the application examples 1 to 8, wherein, when a transverse maximum consecutive number is defined by a maximum value of a consecutive number of the first type regions in one transverse line-shaped region, an average value of the transverse maximum consecutive number in 12 transverse line-shaped regions included in the target region is larger than an expected value of the transverse maximum consecutive number calculated from a total number of the first type regions in the target region.

This configuration allows further improving the service life of the resistor element.

Here, the present invention can be realized by various forms, for example, can be realized in a form of an internal combustion engine on which the spark plug is mounted or similar form.

DESCRIPTION OF THE PREFERRED EMBODIMENTS

A. Embodiment

Figure 1:
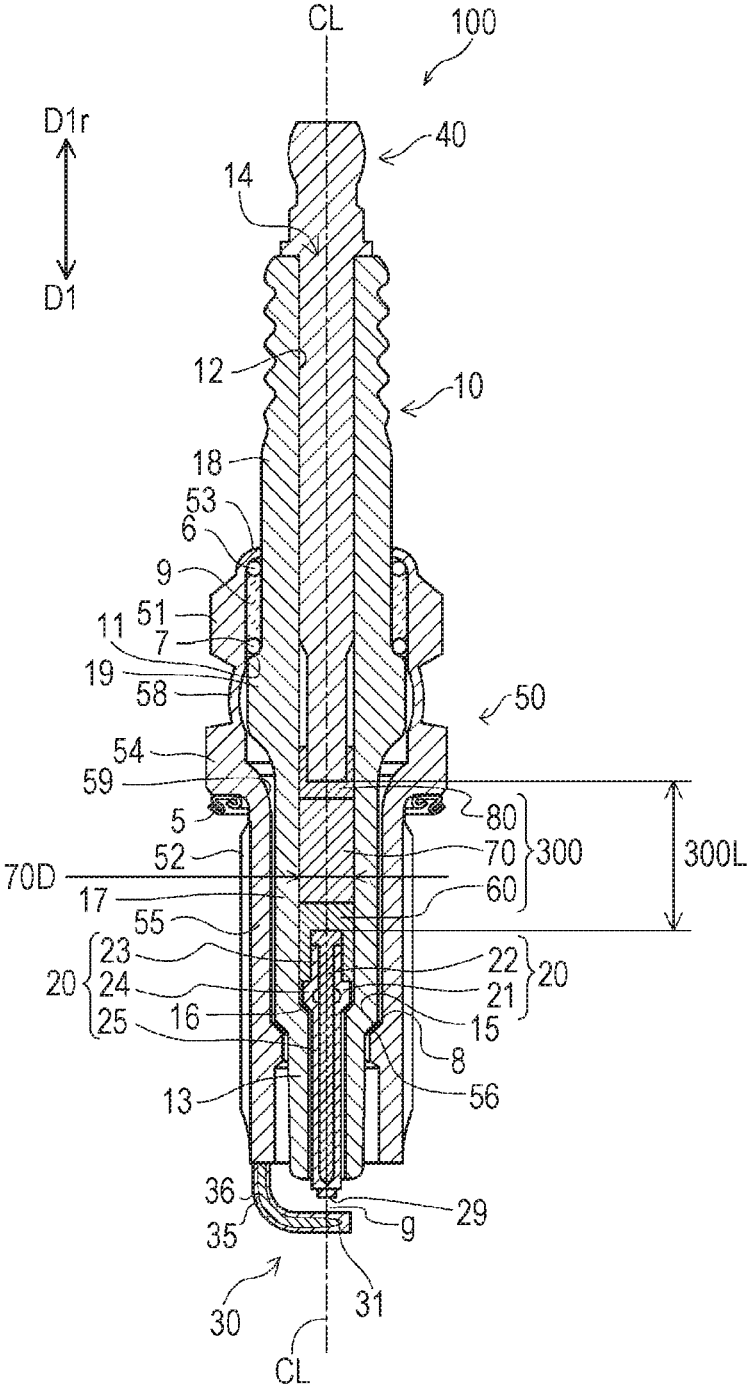
FIG. 1 is a sectional view of an exemplary spark plug.

FIG. 1 is a sectional view of an exemplary spark plug according to a first embodiment. The line CL shown in the drawing denotes the central axis of a spark plug 100. The cross section shown in the drawing is a cross section including a central axis CL. Hereinafter, the central axis CL is also referred to as an "axial line CL" and the direction parallel to the central axis CL is also referred to as an "axial direction." The radial direction of the circle around the central axis CL is also referred to simply as a "radial direction" and the direction of the circumference of the circle around the central axis CL is also referred to as a "circumferential direction." Among directions parallel to the central axis CL, the downward direction in FIG. 1 is referred to as a front end direction D1 while the upward direction is also referred to as a rear end direction D1*r*. The front end direction D1 is the direction from a terminal metal fitting 40 toward electrodes 20 and 30 describe later. The front end direction D1 side in FIG. 1 is referred to as the front end side of the spark plug 100. The rear end direction D1*r* side in FIG. 1 is referred to as the rear end side of the spark plug 100.

The spark plug 100 includes an insulator 10 (hereinafter referred to also as a "ceramic insulator 10"), the center electrode 20, the ground electrode 30, the terminal metal fitting 40, a metal shell 50, a conductive first seal portion 60, a resistor element 70, a conductive second seal portion 80, a front-end-side packing 8, a talc 9, a first rear-end-side packing 6, and a second rear-end-side packing 7.

The insulator 10 is an approximately cylindrically-shaped member with a through hole 12 (hereinafter referred to also as a "shaft hole 12"). The through hole 12 extends along the central axis CL so as to pass through the insulator 10. The insulator 10 is formed by sintering alumina (another insulating material can also be adopted). The insulator 10 includes a nose portion 13, a first outer-diameter contracted portion 15, a front-end-side trunk portion 17, a flange portion 19, a second outer-diameter contracted portion 11, and a rear-end-side trunk portion 18 that are arranged from the front end side toward the rear end direction D1*r* in this order. The outer diameter of the first outer-diameter contracted portion 15 gradually decreases from the rear end side toward the front end side. In the vicinity (the front-end-side trunk portion 17 in the example of FIG. 1) of the first outer-diameter contracted portion 15 of the insulator 10, an inner-diameter contracted portion 16 is formed. The inner diameter of the inner-diameter contracted portion 16 gradually decreases from the rear end side toward the front end side. The outer diameter of the second outer-diameter contracted portion 11 gradually decreases from the front end side toward the rear end side.

Into the front end side of the shaft hole 12 of the insulator 10, a rod-shaped center electrode 20 is inserted. The center electrode 20 extends along the central axis CL. The center electrode 20 includes a nose portion 25, a flange portion 24, and a head 23 that are arranged from the front end side toward the rear end direction D1*r* in this order. The portion on the front end side of the nose portion 25 is exposed to the outside of the shaft hole 12 on the front end side of the insulator 10. The surface on the front end direction D1 side of the flange portion 24 is supported by the inner-diameter contracted portion 16 of the insulator 10. The center electrode 20 includes an outer layer 21 and a core portion 22. The rear end portion of the core portion 22 is exposed from the outer layer 21 so as to form the rear end portion of the center electrode 20. The other portion of the core portion 22 is coated with the outer layer 21. However, the entire core portion 22 may be covered with the outer layer 21.

The outer layer 21 is formed using a material excellent in oxidation resistance compared with the core portion 22, that is, a material with little wear in the case where the material is exposed to a combustion gas within the combustion chamber of the internal combustion engine. The material of the outer layer 21 employs, for example, nickel (Ni) or an alloy (for example, Inconel ("INCONEL" is a registered trademark)) containing nickel as a main component. Here, the "main component" means the component at the highest content rate (the same shall apply hereafter). As the content rate, the value expressed by weight percent (wt %) is adopted. The core portion 22 is formed using a material with a thermal conductivity higher than that of the outer layer 21, for example, a material (for example, pure copper or an alloy containing copper as a main component) containing copper.

Into the rear end side of the shaft hole 12 of the insulator 10, a part of the terminal metal fitting 40 is inserted. The terminal metal fitting 40 is formed using a conductive material (for example, metal such as low-carbon steel). Within the shaft hole 12 of the insulator 10, the approximately cylindrically-shaped resistor element 70 is arranged between the terminal metal fitting 40 and the center electrode 20. The resistor element 70 is for reducing electrical noise. The resistor element 70 is formed using a material containing a conductive material (for example, carbon particles), first type particles (for example, $SiO_2$—$B_2O_3$—$Li_2O$—BaO-based glass particles or similar glass particle) with relatively large diameters, and second type particles (for example, $ZrO_2$ particles and $TiO_2$ particles) with relatively small diameters. In the drawing, a resistor element diameter 70D is the outer diameter of the resistor element 70. In this embodiment, the resistor element diameter 70D is the same as the inner diameter of the portion that houses the resistor element 70 in the through hole 12 of the insulator 10.

Within the through hole 12 of the insulator 10, the conductive first seal portion 60 is arranged between the resistor element 70 and the center electrode 20. Between the resistor element 70 and the terminal metal fitting 40, the conductive second seal portion 80 is arranged. The seal portions 60 and 80 are formed using, for example, materials containing the glass particles that are the same as those contained in the material of the resistor element 70 and containing metal particles (for example, Cu).

The center electrode 20 and the terminal metal fitting 40 are electrically connected to each other via the resistor element 70 and the seal portions 60 and 80. Hereinafter, the entire member (here, the plurality of members 60, 70, and 80) that electrically connects the center electrode 20 and the terminal metal fitting 40 together within the through hole 12 is referred to as a connecting portion 300. In the drawing, a connecting portion length 300L is a distance in the direction parallel to the central axis CL between the rear end (the end on the rear end direction D1*r* side) of the center electrode 20 and the front end (the end on the front end direction D1 side) of the terminal metal fitting 40.

The metal shell 50 is an approximately cylindrically-shaped member with a through hole 59, which extends along the central axis CL so as to pass through the metal shell 50, (in this embodiment, the central axis of the metal shell 50 coincides with the central axis CL of the spark plug 100). The metal shell 50 is formed using a low-carbon steel material (or another conductive material (for example, a metallic material) can also be adopted). The insulator 10 is inserted into the through hole 59 of the metal shell 50. The metal shell 50 is secured to the outer periphery of the insulator 10. On the front end side of the metal shell 50, the front end (in this embodiment, the portion on the front end side of the nose portion 13) of the insulator 10 is exposed to the outside of the through hole 59. On the rear end side of the metal shell 50, the rear end (in this embodiment, the portion on the rear end side of the rear-end-side trunk portion 18) of the insulator 10 is exposed to the outside of the through hole 59.

The metal shell 50 includes a trunk portion 55, a seat portion 54, a deformed portion 58, a tool engagement portion 51, and a crimp portion 53 that are arranged from the front end side toward the rear end side in this order. The seat portion 54 is a flanged portion. On the outer peripheral surface of the trunk portion 55, a screw portion 52 is formed to be threadably mounted on the mounting hole of the internal combustion engine (for example, a gasoline engine). Between the seat portion 54 and the screw portion 52, an annular gasket 5 is fitted. The gasket 5 is formed by folding a metal plate.

The metal shell 50 includes an inner-diameter contracted portion 56 arranged on the front end direction D1 side with respect to the deformed portion 58. The inner diameter of the inner-diameter contracted portion 56 gradually decreases from the rear end side toward the front end side. Between the inner-diameter contracted portion 56 of the metal shell 50 and the first outer-diameter contracted portion 15 of the insulator 10, the front-end-side packing 8 is sandwiched. The front-end-side packing 8 is made of steel, and is an O-shaped ring (another material (for example, metallic material such as copper) can also be adopted).

The shape of the tool engagement portion 51 is a shape (for example, a hexagonal prism) with which a spark plug wrench is engaged. On the rear end side of the tool engagement portion 51, the crimp portion 53 is disposed. The crimp portion 53 is arranged on the rear end side with respect to the second outer-diameter contracted portion 11 of the insulator 10 so as to form the rear end (that is, the end on the rear end direction D1*r* side) of the metal shell 50. The crimp portion 53 is flexed to radially inside. On the front end direction D1 side of the crimp portion 53, the first rear-end-side packing 6, the talc 9, and the second rear-end-side packing 7 are arranged in this order toward the front end direction D1 between the inner peripheral surface of the metal shell 50 and the outer peripheral surface of the insulator 10. In this embodiment, these rear-end-side packings 6 and 7 are C-shaped rings made of steel (another material can also be adopted).

During manufacture of the spark plug 100, the crimp portion 53 is crimped so as to be folded to the inside. Then, the crimp portion 53 is pressed toward the front end direction D1 side. Accordingly, the deformed portion 58 deforms, and the insulator 10 is pressed toward the front end side via the packings 6 and 7 and the talc 9 within the metal shell 50. The front-end-side packing 8 is pressed between the first outer-diameter contracted portion 15 and the inner-diameter contracted portion 56 so as to seal the gap between the metal shell 50 and the insulator 10. With the above-described configuration, the metal shell 50 is secured to the insulator 10.

The ground electrode 30 is sealed to the front end (that is, the end on the front end direction D1 side) of the metal shell 50. In this embodiment, the ground electrode 30 is a rod-shaped electrode. The ground electrode 30 extends from the metal shell 50 toward the front end direction D1, is bent toward the central axis CL, and reaches a front end portion 31. The front end portion 31 forms a gap g with a front end surface 29 (the surface 29 on the front end direction D1 side) of the center electrode 20. The ground electrode 30 is sealed to the metal shell 50 to be electrically conductive (for example, by laser beam welding). The ground electrode 30 includes a base material 35 and a core portion 36. The base material 35 forms the surface of the ground electrode 30. The core portion 36 is buried within the base material 35. The base material 35 is formed, for example, using Inconel. The core portion 36 is formed using a material (for example, pure copper) with a higher thermal conductivity than that of the base material 35.

As the method for manufacturing this spark plug 100, any method can be adopted. For example, the following manufacturing method can be adopted. Firstly, the insulator 10, the center electrode 20, the terminal metal fitting 40, the metal shell 50, and the rod-shaped ground electrode 30 are manufactured by a well-known method. Additionally, the respective material powders of the seal portions 60 and 80 and material powders of the resistor element 70 are prepared.

In the case where the powder material of the resistor element 70 is prepared, firstly, a conductive material, the second type particles (for example, $ZrO_2$ particles and $TiO_2$ particles), which have larger diameters than the diameters of the particles of the conductive material, and a binder are mixed together. As the conductive material, for example, carbon particles such as carbon black can be adopted. As the binder, for example, a dispersant such as polycarboxylic acid can be adopted. To these materials, water is added as solvent. The added materials are mixed using wet ball mill. Then, the mixture is used to generate particles by a spray drying method. Subsequently, the particles of the mixture and the first type particles (for example, glass particles), which have larger diameters than the diameters of the second type particles, are mixed together with the addition of water. Then, drying the obtained mixture causes generation of the powder material of the resistor element 70. Thus, since the second type particles to which the conductive material is attached are mixed with the first type particles, the conductive material can be dispersed compared with the case where the conductive material is directly mixed with the first type particles.

Subsequently, the center electrode 20 is inserted from an opening (hereinafter referred to as a "rear opening 14") on the rear end direction D1*r* side of the through hole 12 of the insulator 10. As described in FIG. 1, the center electrode 20 is supported by the inner-diameter contracted portion 16 of the insulator 10 so as to be arranged in a predetermined position within the through hole 12.

Subsequently, an input of the respective material powders of the first seal portion 60, the resistor element 70, and the second seal portion 80 and shaping of the input powder materials are performed in the order corresponding to the members 60, 70, and 80. The powder material is input from the rear opening 14 of the through hole 12. The input powder material is shaped using a rod inserted from the rear opening 14. The material powders are shaped into approximately the same shape as the shape of the corresponding member.

Subsequently, the insulator 10 is heated up to a predetermined temperature higher than the softening temperature of the glass component included in the respective material powders. In the state heated up to the predetermined temperature, the terminal metal fitting 40 is inserted into the through hole 12 from the rear opening 14 of the through hole 12. As a result, the respective material powders are compressed and sintered so as to form each of the seal portions 60 and 80 and the resistor element 70.

Subsequently, the metal shell 50 is assembled to the outer periphery of the insulator 10 so as to secure the ground electrode 30 to the metal shell 50. Subsequently, the ground electrode 30 is flexed so as to complete a spark plug.

B. First Evaluation Test

B-1. Outline of First Evaluation Test

In a first evaluation test, a sample of the spark plug 100 of the embodiment was used to evaluate the suppression performance of the radio wave noise and the load life. Table 1 below shows the relationship between the number for the type of the sample, a first type line number NL1, a component ratio R (Ti/Zr), a second type line number NL2, an average value NcpA of a longitudinal maximum consecutive number Ncp, the connecting portion length 300L (in the unit of mm), the resistor element diameter 70D (in the unit of mm), the evaluation result (hereinafter referred to as a "radio-wave-noise evaluation result") of the suppression performance of the radio wave noise, and the evaluation result of the load life. In this evaluation test, the samples of 23 types from No. 1 to No. 23 were evaluated.

TABLE 1

| No. | First Type Line Number NL1 (Nc ≥ 2) | Component Ratio R (Ti/Zr) | Second Type Line Number NL2 (Ncc ≥ 2) | Average Value NcpA of Longitudinal Maximum Consecutive Number Ncp | Connecting Portion Length 300L | Resistor Element Diameter 70D | Radio-Wave-Noise Evaluation Result | Load-Life Evaluation Result |
|---|---|---|---|---|---|---|---|---|
| 1 | 1 | 1 | 0 | 3.0 | 11 | 3.5 | 2 | 2 |
| 2 | 5 | 1 | 3 | 1.9 | 11 | 3.5 | 4 | 6 |
| 3 | 5 | 1 | 5 | 1.8 | 11 | 3.5 | 4 | 9 |
| 4 | 7 | 1 | 3 | 2.1 | 11 | 3.5 | 4 | 6 |
| 5 | 7 | 1 | 5 | 2.0 | 11 | 3.5 | 4 | 9 |
| 6 | 8 | 1 | 6 | 2.1 | 11 | 3.5 | 4 | 9 |
| 7 | 10 | 1 | 7 | 3.1 | 11 | 3.5 | 4 | 10 |
| 8 | 12 | 1 | 10 | 3.3 | 11 | 3.5 | 5 | 10 |
| 9 | 12 | 1 | 10 | 5.0 | 11 | 3.5 | 5 | 10 |
| 10 | 12 | 1 | 10 | 6.0 | 11 | 3.5 | 4 | 9 |
| 11 | 12 | 0 | 10 | 3.2 | 11 | 3.5 | 5 | 7 |
| 12 | 12 | 0.05 | 10 | 3.3 | 11 | 3.5 | 5 | 8 |
| 13 | 12 | 0.5 | 10 | 3.0 | 11 | 3.5 | 5 | 10 |
| 14 | 12 | 2 | 10 | 3.1 | 11 | 3.5 | 5 | 10 |
| 15 | 12 | 3 | 10 | 2.8 | 11 | 3.5 | 5 | 10 |
| 16 | 12 | 6 | 10 | 2.7 | 11 | 3.5 | 4 | 10 |
| 17 | 12 | 10 | 10 | 2.7 | 11 | 3.5 | 3 | 10 |
| 18 | 1 | 1 | 0 | 0.9 | 11 | 4 | 1 | 3 |
| 19 | 10 | 1 | 7 | 3.1 | 11 | 4 | 4 | 10 |
| 20 | 1 | 1 | 0 | 0.8 | 11 | 2.9 | 3 | 1 |
| 21 | 10 | 1 | 7 | 3.0 | 11 | 2.9 | 5 | 10 |
| 22 | 1 | 1 | 0 | 0.8 | 15 | 3.5 | 3 | 1 |
| 23 | 10 | 1 | 7 | 3.0 | 15 | 3.5 | 5 | 10 |

The line numbers NL1 and NL2 and the average value NcpA are specified based on the analysis result of the cross section of the resistor element 70 (details will be described below). The component ratio R is the proportion (weight proportion) of the amount of a Ti element to the amount of a Zr element in the resistor element 70 (that is, a filler). This proportion was specified by scraping off a part of the resistor element 70 and analyzing the scraped portion using Inductively Coupled Plasma Atomic Emission Spectroscopy (ICP emission spectroscopy). Here, the material of the resistor element 70 of each sample employed the material that contained carbon black as the conductive material, $SiO_2$—$B_2O_3$—$Li_2O$—BaO-based glass particles as the first type particles, and $ZrO_2$ particles and $TiO_2$ particles as the second type particles.

The radio-wave-noise evaluation result was determined using the attenuation of the radio wave noise. The attenuation was measured in accordance with the box method specified by JASO D002-2 (2004). Specifically, for each sample number, five samples with the same configuration were manufactured. In the configuration, the resistance value was within a range of 1.40±0.05 (kΩ). Then, the average values of the attenuations of the five samples at 300 MHz were used to determine the evaluation values. The evaluation value was calculated by adding 1 point for each increase of 0.1 dB in improved value of the average attenuation compared with the reference. The average attenuation of the sample No. 16 was set to the reference (1 point). For example, in the case where the improved value from the average attenuation of No. 16 is equal to or more than 0.1 dB and less than 0.2 dB, the radio-wave-noise evaluation result is 2 points.

The load life denotes the durability against discharging. To evaluate the durability, for each sample number, five samples with the same configuration were manufactured. In the configuration, the resistance value was within a range of 1.40±0.05 (kΩ). The manufactured sample was manufactured under the same conditions as those of the sample with the same number used for evaluation of the suppression performance of the radio wave noise. Then, the sample was connected to a power source so as to perform an operation for repeating a multiple discharge under the following conditions. The following conditions are conditions severer than general usage conditions.

Temperature: 400 degrees Celsius

Discharge Cycle: 60 Hz

Energy Output from Power Source in 1 Cycle: 400 mJ

In the evaluation test, the operation was performed under the above-described conditions. After the operation, the electric resistance value at ordinary temperature between the center electrode 20 and the terminal metal fitting 40 was measured. The operation and the measurement of the electric resistance value were repeated until the electric resistance value of at least one sample of the five samples after the operation was increased up to a value that was 1.5 times or more larger than the electric resistance value before the evaluation test. Then, the evaluation result was determined as follows based on the total operating period when the electric resistance value of at least one sample after the operation had been increased up to a value that was 1.5 times or more larger than the electric resistance value before the evaluation test.

Total Operating Period: Evaluation Result

Less Than 10 hours: 1 point 10 hours Or More, Less Than 20 hours: 2 points 20 hours Or More, Less Than 100 hours: 3 points 100 hours Or More, Less Than 120 hours: 4 points 120 hours Or More, Less Than 140 hours: 5 points (after that, 1 point is added for each increase of 20 hours in total operating period)

Figure 2:
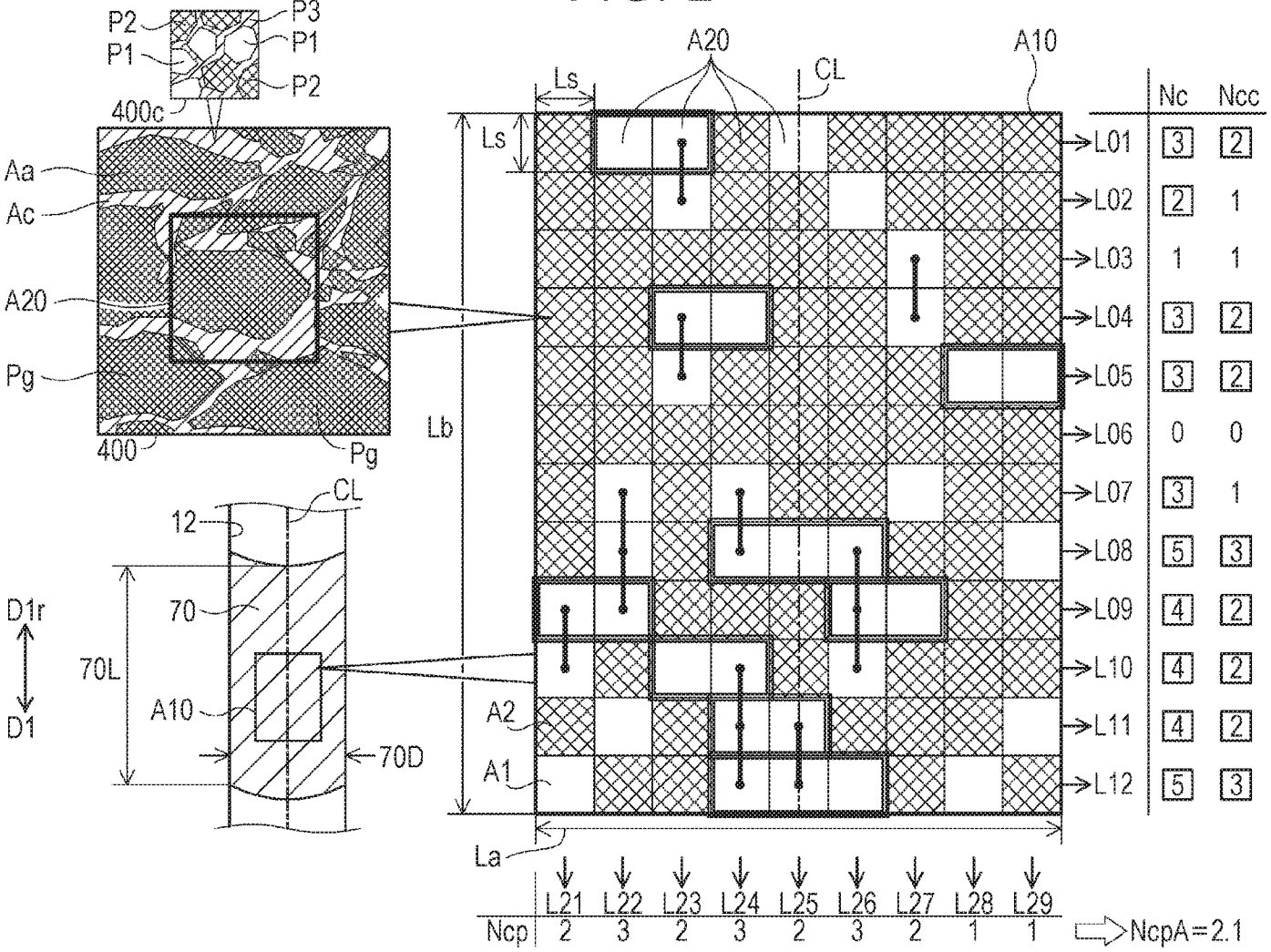
FIG. 2 is an explanatory diagram of a cross section including a central axis CL of a resistor element 70 and a target region A10 on the cross section.

The following describes the line numbers NL1 and NL2 shown in Table 1. FIG. 2 is an explanatory diagram of a cross section including the central axis CL in the resistor element 70 and a target region A10 on the cross section. The left lower portion of FIG. 2 shows the cross section including the central axis CL in the resistor element 70 within the through hole 12. The target region A10 is shown on the cross section of the resistor element 70 shown in the drawing. This target region A10 is a rectangular region that employs the central axis CL (the axial line CL) as the center line. The rectangular shape includes two sides parallel to the central axis CL and two sides perpendicular to the central axis CL. The shape of the target region A10 is line symmetric with respect to the central axis CL as a symmetry axis. The target region A10 is arranged not to protrude from the resistor element 70. Here, as shown in the drawing, the end face on the front end direction D1 side and the end face on the rear end direction D1*r* side of the resistor element 70 might be curved. A resistor element length 70L in the drawing is the length in the direction parallel to the central axis CL in the resistor element 70. The resistor element length 70L corresponds to the length of the portion whose entire region surrounded by the inner peripheral surface of the insulator 10 is occupied by the resistor element 70 in the cross section perpendicular to the central axis CL.

The right side portion of FIG. 2 shows an enlarged diagram of the target region A10. A first length La is a length in the direction perpendicular to the central axis CL of the target region A10. A second length Lb is a length in the direction parallel to the central axis CL of the target region A10. Here, the first length La is 1800 μm while the second length Lb is 2400 μm.

As shown in the drawing, the target region A10 is divided into a plurality of square regions A20. In the square region A20, a length Ls of one side is 200 μm. Accordingly, within the target region A10, the number of the square regions A20 in the direction parallel to the central axis CL is 12 while the number of the square regions A20 in the direction perpendicular to the central axis CL is 9. Hereinafter, the line-shaped region constituted of the nine square regions A20 arranged in the direction perpendicular to the central axis CL is referred to as a transverse line-shaped region. The line-shaped region constituted of the 12 square regions A20 arranged in the direction parallel to the central axis CL is referred to as the longitudinal line-shaped region. As shown in FIG. 2, the target region A10 is divided into 12 transverse line-shaped regions L01 to L12 arranged toward the front end direction D1. Additionally, the target region A10 is divided into nine longitudinal line-shaped regions L21 to L29 arranged toward the direction perpendicular to the central axis CL.

In the top-left portion of FIG. 2, a partial cross section 400 is shown. The partial cross section 400 includes one square region A20. This partial cross section 400 shows a part of the cross section of the resistor element 70. As shown in the drawing, the cross section includes aggregate regions Aa and conductive regions Ac sandwiched between the aggregate regions Aa. The aggregate region Aa is hatched with a relatively dark color while the conductive region Ac is hatched with a relatively light color.

The aggregate region Aa is mainly formed of the first type particles (here, glass particles). The aggregate region Aa includes a relatively large particulate portion (for example, a portion Pg in the drawing). This particulate portion Pg is formed of glass particles. Hereinafter, the particulate portion with the maximum particle diameter of 20 μm or more in the resistor element 70 is referred to as the "aggregate." In the sample evaluated in the evaluation test, the portion formed of glass particles (for example, the portion Pg) corresponds to the aggregate.

The conductive region Ac is mainly formed of the second type particle (here, $ZrO_2$ and $TiO_2$) and the conductive material (here, carbon). Above the partial cross section 400 in the drawing, a partial enlarged diagram 400*c* of the conductive region Ac is shown. As shown in the drawing, the conductive region Ac includes a zirconia portion P1, which is a portion formed of $ZrO_2$, a titania portion P2, which is formed of $TiO_2$, and another component portion P3, which is formed of another component (for example, glass melted during manufacture). In the drawing, the titania portion P2 and the other component portion P3 are hatched.

In the cross section, the zirconia portion P1 and the titania portion P2 form particulate regions. Hereinafter, the particulate portion with the maximum particle diameter of less than 20 μm in the resistor element 70 is referred to as the "filler." In the sample evaluated in the evaluation test, the filler of the resistor element 70 includes the zirconia portion P1 and the titania portion P2. Here, the $ZrO_2$ material powder, which was the material of the zirconia portion P1, had the average grain diameter of 3 μm. The $TiO_2$ material powder, which was the material of the titania portion P2, had the average grain diameter of 5 μm. In the completed resistor element 70, the average grain diameter of the zirconia portion P1 and the average grain diameter of the titania portion P2 are approximately the same as the average grain diameters of the respective material powders.

As described above, the conductive material (here, carbon) is dispersed in the state attached to the filler (for example, the $ZrO_2$ particle). Accordingly, the conductive material is distributed in the zirconia portion P1 and its vicinity, that is, in the conductive region Ac. The conductive region Ac achieves the conductive property using the conductive material. Thus, it can be said that the zirconia portion P1 shows the current path in the resistor element 70. In other words, during discharge, a current does not flow in the aggregate region Aa but mainly flows in the zirconia portion P1 and its vicinity.

To specify the line numbers NL1 and NL2 and the average value NcpA in Table 1, the zirconia portion P1 within the target region A10 was specified. The zirconia portion P1 was specified by analyzing the $ZrO_2$ distribution within the target region A10 using a scanning electron microscope/an energy-dispersive X-ray spectrometer (SEM/EDS). As the analyzer, JSM-6490LA made by JEOL Ltd. was used. For the analysis, the sample of the spark plug 100 was cut along the plane including the central axis CL, and then the cross section of the resistor element 70 was mirror polished. As the sample, the samples manufactured under the same conditions as the samples used in the evaluation of the suppression performance of the radio wave noise and the evaluation of the load life were used. The mirror polished cross section was analyzed using the analyzer. Here, the accelerating voltage was set to 20 kV and the number of sweeps was set to 50. Then, EDS mapping was performed. The result of the EDS mapping was saved as black-and-white (that is, binary) bit-mapped image data. At this time, through the operation menu of "Tools-Histogram" in the analysis tool of the analyzer, setting of the threshold in the black-and-white image was performed. In the setting, the value equal to or more than 20% of the maximum value was set to white while the value less than 20% was set to black. In the image thus obtained, the white region was adopted as the zirconia portion P1.

Here, in the case where the threshold is set, the integer obtained by rounding the value of 20% of the maximum value to the nearest whole number was adopted as the threshold upper limit. The value obtained by subtracting the threshold upper limit from 1 was adopted as the threshold lower limit Setting the threshold lower limit to the value obtained by subtracting the threshold upper limit from 1 allows black and white binarization without generating the portion with the intermediate color (gray) between black and white. For example, in the case where the maximum value is 35, the threshold upper limit is set to 7 (35×20%) and the threshold lower limit is set to 6. In this case, a region with a value equal to or more than 7 is categorized into a white region and a region with a value less than 7 is categorized into a black region. Also in the case where the maximum value is 37, the threshold upper limit is set to 7 and the threshold lower limit is set to 6 similarly. In the case where the maximum value is 38, the threshold upper limit is set to 8 and the threshold lower limit is set to 7.

The first type line number NL1 in Table 1 was determined using the zirconia portion P1 thus specified. Specifically, for each of the 108 square regions A20 included in the target region A10, the proportion of the area of the zirconia portion P1 was calculated. Then, the square region A20 where the area proportion of the zirconia portion P1 was equal to or more than 25% was categorized into a first type region A1. The square region A20 where the area proportion of the zirconia portion P1 was less than 25% was categorized into a second type region A2. In the example of FIG. 2, the second type region A2 is hatched. In the drawing, a first type region number Nc shown on the right side of the target region A10 denotes the number of the first type regions A1 included in each transverse line-shaped region. For example, the first type region number Nc of the second transverse line-shaped region L02 is 2. As described above, the zirconia portion P1 is likely to cause a current flow compared with the aggregate region Aa. Accordingly, the large first type region number Nc shows that the current is likely to flow along that transverse line-shaped region, that is, in the direction intersecting with the central axis CL.

The first type line number NL1 in Table 1 is the number of transverse line-shaped regions (hereinafter referred to as "first type lines") with the first type region number Nc of 2 or more. The large first type line number NL1 means that the current is likely to flow through the respective many transverse line-shaped regions (for example, NL1 lines of the transverse line-shaped regions) along the extending directions of the respective transverse line-shaped regions. Accordingly, in the case where the first type line number NL1 is large, the current flowing through the resistor element 70 can pass through a complicated path passing through a plurality of transverse line-shaped regions. In the case where the current passes through the complicated path, the radio wave noise can be reduced compared with the case where the current passes through a straight path parallel to the central axis CL. The effect for reducing the radio wave noise is estimated to be larger as the shape of the path becomes more complicated, that is, the first type line number NL1 becomes larger. Additionally, in the case where the current passes through the complicated path, the current can be dispersed within the resistor element 70 compared with the case where the current passes through a straight path parallel to the central axis CL. Accordingly, a local deterioration of the resistor element 70 is estimated to be reduced as the first type line number NL1 becomes larger.

In FIG. 2, the first type region number Nc of 2 or more is enclosed in a square. In the example of FIG. 2, the number of lines with the first type region numbers Nc of 2 or more, that is, the first type line number NL1 is 10 lines.

The second type line number NL2 in Table 1 was determined using a transverse maximum consecutive number Ncc shown next to the first type region number Nc in FIG. 2. When the portion including the consecutive first type regions A1 within one transverse line-shaped region is referred to as a transverse consecutive portion, the transverse maximum consecutive number Ncc is the maximum value of the number of the first type regions A1 included in one transverse consecutive portion. In FIG. 2, the transverse consecutive portion is shown by the double line. For example, the transverse maximum consecutive number Ncc of the fourth transverse line-shaped region L04 is 2. The large transverse maximum consecutive number Ncc shows that the current is more likely to flow along that transverse line-shaped region.

The second type line number NL2 in Table 1 is the number of transverse line-shaped regions (hereinafter referred to also as "second type lines") with the transverse maximum consecutive number Ncc of 2 or more. The large second type line number NL2 means that the current is more likely to flow through the respective many transverse line-shaped regions (for example, NL2 lines of the transverse line-shaped regions) along the extending directions of the respective transverse line-shaped regions. Accordingly, in the case where the second type line number NL2 is large, the current flowing through the resistor element 70 is likely to pass through a complicated path passing through a plurality of transverse line-shaped regions. This allows further reducing the radio wave noise. The effect for reducing the radio wave noise is estimated to be larger as the shape of the path becomes more complicated, that is, the second type line number NL2 becomes larger. Additionally, in the case where the current passes through the complicated path, the current can be dispersed within the resistor element 70 compared with the case where the current passes through a straight path parallel to the central axis CL. Accordingly, a local deterioration of the resistor element 70 is estimated to be reduced as the second type line number NL2 becomes larger.

In FIG. 2, the transverse maximum consecutive number Ncc of 2 or more is enclosed in a square. In the example of FIG. 2, the number of lines with the transverse maximum consecutive numbers Ncc of 2 or more, that is, the second type line number NL2 is 8 lines.

The average value NcpA of the longitudinal maximum consecutive number Ncp in Table 1 is the average value of the respective longitudinal maximum consecutive numbers Ncp of the nine longitudinal line-shaped regions L21 to L29 shown in FIG. 2. When the portion including the consecutive first type regions A1 within one longitudinal line-shaped region is referred to as a longitudinal consecutive portion, the longitudinal maximum consecutive number Ncp is the maximum value of the number of the first type regions A1 included in one longitudinal consecutive portion. In FIG. 2, the longitudinal consecutive portion is shown by the bold line connecting a plurality of the first type regions A1 that forms the longitudinal consecutive portion. For example, the longitudinal maximum consecutive number Ncp of the fourth longitudinal line-shaped region L24 is 3. In the example of FIG. 2, the average value NcpA of the nine longitudinal maximum consecutive number Ncp is 2.1. The large longitudinal maximum consecutive number Ncp shows that the current is likely to flow along that longitudinal line-shaped region.

Here, analySIS Five (trade name) of image analysis software by Soft Imaging System GmbH was used for analysis of the bit-mapped image data, that is, calculation of the area to specify the first type region A1, the second type region A2, and the average value NcpA and calculation of the first type line number NL1, the second type line number NL2, and the average value NcpA. Additionally, the line numbers NL1 and NL2 and the average value NcpA in Table 1 are the average values of the analysis results of the two target region A10 in different positions on the cross section of one sample.

B-2. First Type Line Number NL1 and Evaluation Result:

The respective first type line numbers NL1 of No. 1 to No. 10 in Table 1 were 1, 5, 5, 7, 7, 8, 10, 12, 12, and 12. In these 10 types of samples, the component ratio R had the same value of 1, the connecting portion length 300L had the same value of 11 mm, and the resistor element diameter 70D had the same value of 3.5 mm. The resistor element length 70L (in FIG. 2) was approximately 8 mm.

As shown by No. 1 to No. 10, the radio-wave-noise evaluation result was favorable in the case where the first type line number NL1 was large compared with the case where the first type line number NL1 was small. The evaluation result of the load life was favorable in the case where the first type line number NL1 was large compared with the case where the first type line number NL1 was small. As the reason for these results, it is estimated that this is because the shape of the current path becomes more complicated as the first type line number NL1 becomes larger as described above.

The first type line numbers NL1 that were able to achieve the radio-wave-noise evaluation result more favorable than 2 points and the load-life evaluation result more favorable than 2 points were 5, 7, 8, 10, and 12. Any value selected from these values can be adopted as the lower limit of a preferred range (the lower limit or more and the upper limit or less) of the first type line number NL1. For example, as the first type line number NL1, the value of 5 lines or more can be adopted. Additionally, any value of the lower limit or more among these values can be adopted as the upper limit of the preferred range of the first type line number NL1. For example, as the first type line number NL1, the value of 12 lines or less can be adopted.

Here, from the aspect of improvement of the radio-wave-noise evaluation result, it is estimated that the path of the current flowing within the resistor element 70 is preferred to be thin and complicated in an intricate pattern. However, in the case where the current path is thin, the current path is more likely to be cut due to heat and vibration (that is, the load life is short) compared with the case where the current path is thick. Therefore, in this evaluation test, as described in FIG. 2, the first type region A1 in which the current is relatively likely to flow and the second type region A2 in which the current is relatively less likely to flow were determined using the proportion of the area of the zirconia portion P1 in the square region A20 where one side had the length of 200 μm that was larger than the filler. In this case, in the case where the current path formed by the zirconia portion P1 is excessively thin, the square region A20 is not categorized into the first type region A1. In the case where the current path is thick to some extent, the square region A20 is categorized into the first type region A1. Using this first type region A1 allowed obtaining the parameter correlated with both the radio-wave-noise evaluation result and the load-life evaluation result, that is, the first type line number NL1. Here, in the case where the length of one side of the square region A20 is larger than 200 μm, the line number NL1 is increased even when the current path (for example, a thick current path extending in parallel to the central axis CL) with a small influence on the reduction of the radio wave noise is formed. Accordingly, the correlation between the first type line number NL1 and the radio-wave-noise evaluation result is estimated to become weak. The same applies to the second type line number NL2 described below.

B-3. Second Type Line Number NL2 and Evaluation Result:

The respective second type line numbers NL2 of No. 1 to No. 10 in Table 1 were 0, 3, 5, 3, 5, 6, 7, 10, 10, and 10. As shown by these samples, the radio-wave-noise evaluation result and the load-life evaluation result were favorable in the case where the second type line number NL2 was large compared with the case where the second type line number NL2 was small. As the reason for these results, it is estimated that this is because the shape of the current path becomes more complicated as the second type line number NL2 becomes larger as described above.

Here, the second type line numbers NL2 that were able to achieve the load-life evaluation result more favorable than 2 points were 3, 5, 6, 7, and 10. Any value selected from these values can be adopted as the lower limit of a preferred range (lower limit or more and the upper limit or less) of the second type line number NL2. For example, as the second type line number NL2, the value of 3 lines or more can be adopted. Additionally, the second type line numbers NL2 that were able to achieve the load-life evaluation result more favorable than 6 points were 5, 6, 7, and 10. Accordingly, as the second type line number NL2, the value of 5 lines or more is preferred to be adopted. Additionally, the best second type line numbers NL2 that were able to achieve the load-life evaluation result of 10 points were 7 and 10. Accordingly, as the second type line number NL2, the value of 7 lines or more is preferred to be adopted. Here, it is estimated that the large second type line number NL2 achieves a more favorable load-life evaluation result. Accordingly, as the second type line number NL2, it is estimated that various values equal to or less than 12 lines, which is the theoretical maximum, can be adopted. Additionally, as the upper limit, any value of the lower limit or more selected from the above-described evaluated values (for example, 3, 5, 6, 7, and 10) can be adopted.

B-4. Component Ratio R (Ti/Zr) and Evaluation Result:

The respective component ratios R (Ti/Zr) of No. 11 to No. 17 in Table 1 were 0, 0.05, 0.5, 2, 3, 6, and 10. In these seven types of samples, the first type line number NL1 had the same value of 12, the second type line number NL2 had the same value of 10, the connecting portion length 300L had the same value of 11 mm, and the resistor element diameter 70D had the same value of 3.5 mm. The configurations of the samples No. 11 to No. 17 were otherwise similar to the configurations of the samples No. 1 to No. 10.

As shown by No. 11 to No. 17, the load-life evaluation result was favorable in the case where the component ratio R was large compared with the case where the component ratio R was small. As the reason for this result, it is estimated that this is because the large proportion of $TiO_2$ increases the path of the current passing through $TiO_2$ so as to disperse the current within the resistor element 70, thus reducing the deterioration of the resistor element 70. The radio-wave-noise evaluation result was favorable in the case where the component ratio R was small compared with the case where the component ratio R was large. As the reason for this result, it is estimated that this is because the smaller proportion of $TiO_2$ reduces the path of the current passing through $TiO_2$, thus complicating the current path within the resistor element 70.

In addition to No. 11 to No. 17, taking into consideration No. 1 to No. 10, the component ratios R that were able to achieve the load-life evaluation results of 8 points or more were 0.05, 0.5, 1, 2, 3, 6, and 10. Additionally, the component ratios R that were able to achieve the radio-wave-noise evaluation result of 4 points or more were 0, 0.05, 0.5, 1, 2, 3, and 6. The component ratios R included in both results were six values of 0.05, 0.5, 1, 2, 3, and 6. Any value selected from these six values can be adopted as the lower limit of a preferred range (the lower limit or more and the upper limit or less) of the component ratio R. In the six values, any values of the lower limit or more can be adopted as the upper limit. For example, as the component ratio R, the value that is 0.05 or more and 6 or less can be adopted. More preferably, as the component ratio R, the value that is 0.5 or more and 6 or less can be adopted. Further preferably, as the component ratio R, the value that is 0.5 or more and 3 or less can be adopted.

Here, the component ratios R of No. 1 to No. 10 was 1, and was larger than the lower limit and smaller than the upper limit of the above-described preferred range of the component ratio R. Additionally, as shown by No. 1 to No. 10, in the case where the component ratio R was 1, various combinations of the first type line number NL1 and the second type line number NL2 were able to achieve the radio-wave-noise evaluation result of 4 points or more and the load-life evaluation result of 8 points or more. Accordingly, it is estimated that the above-described preferred range of the component ratio R is applicable to the case where the first type line number NL1 is different from 12, which is the first type line number NL1 of No. 11 to No. 17. Similarly, the above-described preferred range of the component ratio R is applicable to the case where the second type line number NL2 is different from 10, which is the second type line number NL2 of No. 11 to No. 17.

B-5. Resistor Element Diameter 70D and Evaluation Result:

The respective resistor element diameters 70D of No. 18 and No. 19 in Table 1 were 4 mm that was larger than the resistor element diameter 70D (3.5 mm) of No. 1 to No. 17. The configuration of No. 18 had NL1=1, NL2=0, and R=1. The two parameters NL1 and NL2 were out of the above-described preferred ranges. For No. 18, the radio-wave-noise evaluation result was 1 point and the load-life evaluation result was 3 points. On the other hand, the configuration of No. 19 had NL1=10, NL2=7, and R=1. The respective three parameters NL1, NL2, and R were within the above-described preferred ranges. The radio-wave-noise evaluation result of No. 19 was 4 points more favorable than that of No. 18. The load-life evaluation result of No. 19 was 10 points more favorable than that of No. 18.

The respective resistor element diameters 70D of No. 20 and No. 21 in Table 1 were 2.9 mm that is smaller than the resistor element diameter 70D (3.5 mm) of No. 1 to No. 17. The configuration of No. 20 had NL1=1, NL2=0, and R=1. The two parameters NL1 and NL2 were out of the above-described preferred ranges. The radio-wave-noise evaluation result of No. 20 was 3 points and the load-life evaluation result was 1 point. On the other hand, the configuration of No. 21 had NL1=10, NL2=7, and R=1. The respective three parameters NL1, NL2, and R were within the above-described preferred ranges. The radio-wave-noise evaluation result of No. 21 was 5 points more favorable than that of No. 20. The load-life evaluation result of No. 21 was 10 points more favorable than that of No. 20.

Here, in the samples of No. 18 to No. 21, the connecting portion length 300L had the same value of 11 mm. The resistor element length 70L (in FIG. 2) had approximately the same value of 8 mm.

Generally, in the case where the resistor element diameter 70D is small, the surface area of the resistor element 70 is small compared with the case where the resistor element diameter 70D is large. Accordingly, the heat generated due to the flow of the current through the resistor element 70 is less likely to transfer to the other member such as the insulator 10. That is, in the case where the resistor element diameter 70D is small, the load-life evaluation result of the resistor element 70 is likely to be reduced. Additionally, in the case where the resistor element diameter 70D is small, the length of the current path that extends in the direction intersecting with the central axis CL is restricted to be in a range where the length is short. Accordingly, the suppression performance of the radio wave noise is likely to be reduced. Here, as shown in Table 1, the three resistor element diameters 70D of 2.9, 3.5, and 4 (mm) were able to achieve the radio-wave-noise evaluation result of 4 points or more and the load-life evaluation result of 8 points or more. Thus, as the resistor element diameter 70D, the value of 4 mm or less can be adopted, the smaller value of 3.5 mm or less can be adopted, and the further smaller value of 2.9 mm or less can be adopted. Additionally, as the resistor element diameter 70D, when any value (for example, 2.9 mm) of the upper limit or less among the three values is selected as the lower limit, the value of the lower limit or more can be adopted.

Generally, taking into consideration the fact that the achievement of the radio-wave-noise evaluation result of 2 points or more and the load-life evaluation result of 2 points or more allows practical use, the allowable range of the resistor element diameter 70D is estimated to be extendable to a wide range including these three values of (2.9, 3.5, and 4 (mm)) For example, as the resistor element diameter 70D, it is estimated that various values equal to or more than 1.8 mm, which is the first length La of the target region A10, can be adopted. Additionally, taking into consideration the practical size of the spark plug 100, it is estimated that various values of 6 mm or less can be adopted as the resistor element diameter 70D. In each case, it is estimated that setting at least the first type line number NL1 within the above-described preferred range allows achieving the favorable radio-wave-noise evaluation result (for example, 2 points or more) and the favorable load-life evaluation result (for example, 2 points or more). Here, in addition to the first type line number NL1, the second type line number NL2 is preferred to be set within the above-described preferred range. Additionally, the component ratio R is preferred to be set within the above-described preferred range.

B-6. Connecting Portion Length 300L and Evaluation Result:

The respective connecting portion lengths 300L of No. 22 and No. 23 in Table 1 were 15 mm that was larger than the connecting portion length 300L (11 mm) of No. 1 to No. 21. The connecting portion length 300L of 15 mm was achieved by moving the position of the front end (the end on the front end direction D1 side) of the terminal metal fitting 40 toward the rear end direction D1*r* side and then lengthening the length (specifically, the resistor element length 70L in FIG. 2) in the direction parallel to the central axis CL of the resistor element 70. The shape and the size of the first seal portion 60 were approximately the same as those in all the samples No. 1 to No. 21. Similarly, the shape and the size of the second seal portion 80 were approximately the same as those in all the samples No. 1 to No. 21.

The configuration of No. 22 had NL1=1, NL2=0, R=1, and 70D=3.5 mm. The two parameters NL1 and NL2 were out of the above-described preferred ranges. For No. 22, the radio-wave-noise evaluation result was 3 points and the load-life evaluation result was 1 point. On the other hand, the configuration of No. 23 had NL1=10, NL2=7, R=1, and 70D=3.5 mm. The respective four parameters NL1, NL2, R, and 70D were within the above-described preferred ranges. The radio-wave-noise evaluation result of No. 23 was 5 points more favorable than that of No. 22. The load-life evaluation result of No. 23 was 10 points more favorable than that of No. 22.

Generally, in the case where the connecting portion length 300L is long, the manufacture of the connecting portion 300 (including the resistor element 70) is difficult compared with the case where the connecting portion length 300L is short. For example, there is the case where the material of the connecting portion 300 (for example, the resistor element 70) arranged within the through hole 12 is compressed using the rod inserted from the rear opening 14 of the through hole 12. In the case where the connecting portion length 300L is long, the pressure for compression is likely to be dispersed in the course of the connecting portion 300. As a result, the suppression performance of the radio wave noise might be reduced and the durability might be reduced without appropriate compression of the material of the resistor element 70. Here, as shown in Table 1, the two connecting portion lengths 300L of 11 mm and 15 mm achieved the radio-wave-noise evaluation result of 4 points or more and the load-life evaluation result of 8 points or more. Thus, as the connecting portion length 300L, the value of 11 mm or more can be adopted and the longer value of 15 mm or more can be adopted. Additionally, as the connecting portion length 300L, when any value (for example, 15 mm) of the lower limit or more among the two values is selected as the upper limit, the value of the upper limit or less can be adopted.

Generally, taking into consideration the fact that the achievement of the radio-wave-noise evaluation result of 2 points or more and the load-life evaluation result of 2 points or more allows practical use, the allowable range of the connecting portion length 300L is estimated to be extendable to a wide range including these two value (11 and 15 (mm)) For example, as the connecting portion length 300L, it is estimated that various values of 5 mm or more can be adopted. Additionally, as the connecting portion length 300L, it is estimated that various values of 30 mm or less can be adopted. In each case, it is estimated that setting at least the first type line number NL1 within the above-described preferred range allows achieving the favorable radio-wave-noise evaluation result (for example, two points or more) and the favorable load-life evaluation result (for example, two points or more). Here, in addition to the first type line number NL1, the second type line number NL2 is preferred to be set within the above-described preferred range. Additionally, the component ratio R is preferred to be set within the above-described preferred range. Additionally, the resistor element diameter 70D is preferred to be set within the above-described allowable range.

B-7. Average Value NcpA of Longitudinal Maximum Consecutive Number Ncp and Evaluation Result:

According to No. 1 to No. 23 in Table 1, the average values NcpA that were able to achieve the radio-wave-noise evaluation result of 2 points or more were 13 values of 0.8, 1.8, 1.9, 2.0, 2.1, 2.7, 2.8, 3.0, 3.1, 3.2, 3.3, 5.0, and 6.0. Any value selected from these 13 values can be adopted as the lower limit of a preferred range (the lower limit or more and the upper limit or less) of the average value NcpA. Any value of the lower limit or more in the 13 values can be adopted as the upper limit Here, it is estimated that the smaller average value NcpA complicates the current path. Accordingly, as the average value NcpA, it is estimated that the value (for example, various values of zero or more) smaller than the minimum value (0.8) in the above-described 13 values can be adopted. For example, as the average value NcpA, it is estimated that the value that is zero or more and 6.0 or less can be adopted. However, it is estimated that setting the first type line number NL1 within the above-described preferred range causes the average value NcpA of the longitudinal maximum consecutive number Ncp to be also a value larger than zero.

As shown by No. 10 and the other samples, in the case where the average value NcpA is 5.0 or less, the various average values NcpA were able to achieve the radio-wave-noise evaluation result of 5 points. In the case where the average value NcpA was 6.0, the radio-wave-noise evaluation result was 4 points lower than that point. As the reason for this result, it is estimated that this is because an increase in average value NcpA is likely to cause the current to flow along the longitudinal line-shaped region, thus simplifying the current path as a result. With the above-described results, it is estimated that adopting the value of 5.0 or less as the average value NcpA of the longitudinal maximum consecutive number Ncp allows achieving the more favorable radio-wave-noise evaluation result.

In each case, it is estimated that setting at least the first type line number NL1 within the above-described preferred range allows achieving the favorable radio-wave-noise evaluation result (for example, 2 points or more) and the favorable load-life evaluation result (for example, 2 points or more). Here, in addition to the first type line number NL1, the second type line number NL2 is preferred to be set within the above-described preferred range. Additionally, the component ratio R is preferred to be set within the above-described preferred range. Additionally, the resistor element diameter 70D is preferred to be set within the above-described allowable range. Additionally, the connecting portion length 300L is preferred to be set within the above-described allowable range.

C. Second Evaluation Test

C-1. Outline of Second Evaluation Test:

In the second evaluation test, the relationship between the configuration, the suppression performance of the radio wave noise, and the load life for samples of the spark plug 100 according to the embodiment was evaluated. Table 2 below shows, regarding the samples, the relationship between the number for type, the first type line number NL1, the component ratio R (Ti/Zr), the second type line number NL2, a first type region proportion RAL a first-type-region-number expected value NcE, a transverse-maximum-consecutive-number expected value NccE, a determination result of continuity, a transverse-maximum-consecutive-number average value NccA, the connecting portion length 300L (in the unit of mm), the resistor element diameter 70D (in the unit of mm), the radio-wave-noise evaluation result, and the load-life evaluation result. In the second evaluation test, five types of samples No. T1 to No. T5 were evaluated.

TABLE 2

| [Table 2] No. | First Type Line Number NL1 (Nc ≥ 2) | Component Ratio R (Ti/Zr) | Second Type Line Number NL2 (Ncc ≥ 2) | First Type Region Proportion RA1 | First-Type-Region-Number Expected Value NcE | Transverse-Maximum-Consecutive-Number Expected Value NccE | Transverse Line-Shaped Region: Continuity Judgment Result | Transverse Line-Shaped Region: Transverse-Maximum-Consecutive-Number Average Value NccA | Connecting Portion Length 300L | Resistor Element Diameter 70D | Radio-Wave-Noise Evaluation Result | Load-Life Evaluation Result |
|---|---|---|---|---|---|---|---|---|---|---|---|---|
| T1 | 12 | 1 | 12 | 0.935 (101/108) | 8 | 6.2 | A | 7.33 | 11 | 3.5 | 5 | 10 |
| T2 | 6 | 1 | 6 | 0.324 (35/108) | 3 | 1.67 | A | 1.83 | 11 | 3.5 | 5 | 10 |
| T3 | 10 | 1 | 8 | 0.343 (37/108) | 3 | 1.67 | A | 1.75 | 11 | 3.5 | 5 | 10 |
| T4 | 12 | 1 | 10 | 0.454 (49/108) | 4 | 2.21 | A | 2.50 | 11 | 3.5 | 5 | 10 |
| T5 | 12 | 1 | 10 | 0.454 (49/108) | 4 | 2.21 | B | 2.18 | 11 | 3.5 | 5 | 5 |

The respective parameters NL1, R, NL2, 300L, and 70D in Table 2 are the same as the parameters with the same reference numerals in Table 1. The radio-wave-noise evaluation result was determined by the same method as the method of the first evaluation test in Table 1. The load-life evaluation result was determined by the method where "Energy Output from Power Source in 1 Cycle" was changed to 600 mJ larger than 400 mJ in the method of the first evaluation test in Table 1. That is, in the second evaluation test, the load life was evaluated under conditions severer than those of the first evaluation test.

The following describes other parameters in Table 2. The first type region proportion RA1 is the proportion of the total number of the first type regions A1 to the total number of the square regions A20 in the target region A10 (in FIG. 2). As described above, the total number of the square region A20 is 108. In brackets of the column of the first type region proportion RA1 in Table 2, "108" as the total number of the square regions A20 and also the total number of the first type regions A1 are shown. For example, the total number of the first type region A1 in No. T1 is 101.

The first-type-region-number expected value NcE is the expected value of the first type region number Nc (that is, the number of the first type regions A1 included in one transverse line-shaped region). This first-type-region-number expected value NcE is calculated by INT (9*RA1). Here, the function "INT" denotes the function that rounds an argument to the nearest whole number as an integer. The operation symbol "*" denotes multiplication (the same shall apply hereafter). The value "9" is the total number of the square regions A20 included in one transverse line-shaped region. The first-type-region-number expected value NcE thus calculated denotes the total number of the first type regions A1 included in one transverse line-shaped region in the case where the first type regions A1 whose number was specified by the first type region proportion RA1 were equally distributed within the target region A10.

The transverse-maximum-consecutive-number expected value NccE (hereinafter referred to also as a "transverse consecution expected value NccE") is the expected value of the transverse maximum consecutive number Ncc (that is, the maximum value of the number of the first type regions A1 included in one transverse consecutive portion). This transverse consecution expected value NccE is calculated from the transverse maximum consecutive number Ncc that can be achieved based on the first-type-region-number expected value NcE and the combination number CNcc of the arrangements of the first type regions A1 for realizing this transverse maximum consecutive number Ncc. Specifically, the sum of "Ncc*CNcc" regarding all achievable Ncc is divide by the sum of "CNcc" regarding all achievable Ncc. The obtained value is the transverse consecution expected value NccE. That is, the transverse consecution expected value NccE is the average value of the transverse maximum consecutive numbers Ncc in a plurality of arrangement patterns that can be achieved by the first type region A1 and the second type region A2. Here, the total number of the first type region A1 included in one transverse line-shaped region is fixed to the first-type-region-number expected value NcE regardless of the transverse maximum consecutive number Ncc. The transverse maximum consecutive number Ncc that can be achieved based on the first-type-region-number expected value NcE is determined corresponding to the first-type-region-number expected value NcE from a range that is larger than zero and equal to or less than the first-type-region-number expected value NcE.

Firstly, a description will be given of the case where the first-type-region-number expected value NcE is "4." In this case, the achievable transverse maximum consecutive numbers Ncc are "4," "3," "2," and "1." The following describes the respective combination numbers CNcc of these transverse maximum consecutive numbers Ncc.

In the case where Ncc=4, one transverse line-shaped region (that is, nine square regions A20) is decomposed into one transverse consecutive portion (constituted of four first type regions A1) and five second type regions A2. The one transverse consecutive portion and the five second type regions A2 are arranged in one row. Here, the position of the one transverse consecutive portion is selected from six candidate positions formed by the five second type regions A2 arranged in one row. Here, one second type region A2 is expressed by a character "O" and the candidate position of the transverse consecutive portion is expressed by a character "X." In this case, the arrangement of the second type region A2 (O) and the candidate position (X) is "XOXOXOXOXOX." The combination number CNcc of the arrangement of the first type region A1 for realizing "Ncc=4" is the same as the permutation (${}_6P_1$=6) in the case where the position of the one transverse consecutive portion is selected from the six candidate positions (X).

In the case where Ncc=3, one transverse line-shaped region is decomposed into one transverse consecutive portion (constituted of three first type regions A1), one first type region A1, and five second type regions A2. The arrangement of the transverse consecutive portion and the first type region A1 in the positions adjacent to each other is not allowed. In this case, the combination number CNcc is the same as the permutation (${}_6P_2$=30) in the case where the position of one transverse consecutive portion and the position of one first type region A1 are selected from the six candidate positions.

In the case where Ncc=2, one transverse line-shaped region can be decomposed into the following two patterns.

First Pattern: two transverse consecutive portions and five second type regions A2

Second Pattern: one transverse consecutive portion, two first type regions A1, and five second type regions A2

In both patterns, the one transverse consecutive portion is constituted of the two first type regions A1.

In the first pattern, the arrangement of the two transverse consecutive portions in the positions adjacent to each other is not allowed. Additionally, the two transverse consecutive portions cannot be discriminated from each other. Accordingly, the combination number CNcc is the same as the number obtained by dividing the permutation (${}_6P_2$) in the case where the positions of the two transverse consecutive portions are selected from the six candidate positions by the permutation (${}_2P_2$=2!) of the two transverse consecutive portions that cannot be discriminated from each other. Specifically, CNcc=${}_6P_2$/2!=30/2=15.

In the second pattern, the arrangement of the transverse consecutive portion and the first type region A1 in the positions adjacent to each other is not allowed. Additionally, the arrangement of the two first type regions A1 in the positions adjacent to each other is also not allowed. The two first type regions A1 cannot be discriminated from each other. Accordingly, the combination number CNcc is the same as the number obtained by dividing the permutation (${}_6P_3$) in the case where the three positions of the one transverse consecutive portion and the two first type region A1 are selected from the six candidate positions by the permutation (${}_2P_2$=2!) of the two first type regions A1 that cannot be discriminated from each other. Specifically, CNcc=${}_6P_3$/2!=120/2=60.

With the above description, in the case where Ncc=2, the final combination number CNcc is 75 (=15+60).

In the case where Ncc=1, one transverse line-shaped region is decomposed into four first type regions A1 and five second type regions A2. Here, the consecution of two or more first type regions A1 is not allowed. Additionally, the four first type regions A1 cannot be discriminated from each other. Accordingly, the combination number CNcc is the same as the number obtained by dividing the permutation (${}_6P_4$) in the case where the positions of the four first type regions A1 are selected from the six candidate positions by the permutation (${}_4P_4$=4!) of the four first type regions A1 that cannot be discriminated from each other. Specifically, CNcc=6$P_4$/4!=360/24=15.

With the above description, the total number (that is, the summed value of the combination number CNcc) of the arrangements of the four first type regions A1 in the case where the first-type-region-number expected value NcE is 4 is 126 (=6+30+75+15). The transverse consecution expected value NccE is calculated as follows.

$$\Sigma(Ncc*CNcc)=(4*6)+(3*30)+(2*75)+(1*15)=24+90+150+15=279$$

$$NccE=\Sigma(Ncc*CNcc)/\Sigma(CNcc)=279/126=2.21$$

(the operation symbol "Σ" denotes the sum for all achievable Ncc (the same shall apply hereafter))

Accordingly, in the case where the first-type-region-number expected value NcE is "4," the transverse consecution expected value NccE is 2.21.

The following describes the case where the first-type-region-number expected value NcE is "8." In this case, the achievable transverse maximum consecutive numbers Ncc are "8," "7," "6," "5," and "4." Here, Ncc of three or less cannot be used. In the case where Ncc=3, eight first type regions A1 are decomposed into at least three portions that are separated from one another (the respective total numbers of the first type regions A1 in the three portions are 3, 3, and 2). To separate these three portions from one another, at least two second type regions A2 are required. Thus, one transverse line-shaped region requires 10 square regions A20. However, as described above, since the total number of the square regions A20 included in one transverse line-shaped region is 9, Ncc=3 is not achieved. The same applies to the case where the transverse maximum consecutive number Ncc is 2 or less.

In the case where Ncc=8, one transverse line-shaped region is decomposed into one transverse consecutive portion (constituted of eight first type regions A1) and one second type region A2. Here, the one second type region A2 is expressed by a character "O." The candidate position of the one transverse consecutive portion is expressed by a character "X." In this case, the arrangement of the second type region A2 (O) and the candidate position (X) is "XOX." The combination number CNcc of the arrangement of the first type region A1 for realizing "Ncc=8" is the same as the permutation ($_2P_1$=2) in the case where the position of the one transverse consecutive portion is selected from the two candidate positions (X).

In the case where Ncc=7, one transverse line-shaped region is decomposed into one transverse consecutive portion (constituted of seven first type regions A1), one first type region A1, and one second type region A2. The arrangement of the transverse consecutive portion and the first type region A1 in the positions adjacent to each other is not allowed. Accordingly, the combination number CNcc is the same as the permutation ($_2P_2$=2) in the case where the position of the one transverse consecutive portion and the position of the one first type region A1 are selected from the two candidate positions.

In the case where Ncc=6, one transverse line-shaped region is decomposed into two transverse consecutive portions with mutually different sizes and one second type region A2. The respective total numbers of the first type regions A1 of the two transverse consecutive portions are 6 and 2. In the case where Ncc=5, similarly, one transverse line-shaped region is decomposed into two transverse consecutive portions with mutually different sizes and one second type region A2. The respective total numbers of the first type region A1 of the two transverse consecutive portions are 5 and 3. In these cases, the combination number CNcc is the same as the permutation ($_2P_2$=2) in the case where the positions of the two transverse consecutive portions are selected from the two candidate positions.

In the case where Ncc=4, one transverse line-shaped region is decomposed into two transverse consecutive portions with the same size and one second type region A2. The total numbers of the first type regions A1 of the two transverse consecutive portions are 4. The two transverse consecutive portions cannot be discriminated from each other. Accordingly, the combination number CNcc is the same as the number obtained by dividing the permutation ($_2P_2$) in the case where the positions of the two transverse consecutive portions are selected from the two candidate positions by the permutation ($_2P_2$=2!) of the two transverse consecutive portions that cannot be discriminated from each other (specifically, "1").

With the above description, the total number (that is, the summed value of the combination numbers CNcc) of the eight first type regions A1 in the case where the first-type-region-number expected value NcE is 8 is 9 (=2+2+2+2+1). The transverse consecution expected value NccE is calculated as follows.

$$\Sigma(Ncc*CNcc)=(8*2)+(7*2)+(6*2)+(5*2)+(4*1)=16+14+12+10+4=56$$

$$NccE=\Sigma(Ncc*CNcc)/\Sigma(CNcc)=56/9=6.2$$

Accordingly, in the case where the first-type-region-number expected value NcE is "8," the transverse consecution expected value NccE is 6.2.

In the case where the first-type-region-number expected value NcE is different from both of "4" and "8," similarly, the transverse consecution expected value NccE is calculated. Generally, the transverse-maximum-consecutive-number expected value NccE is can be calculated as follows.

(1) The first-type-region-number expected value NcE is calculated from the total number of the first type regions A1 in the target region A10. For example, the first type region proportion RA1 is calculated from the total number of the first type regions A1 in the target region A10, and the first-type-region-number expected value NcE is calculated from the first type region proportion RA1.

(2) The achievable transverse maximum consecutive number Ncc is specified based on the first-type-region-number expected value NcE.

(3) For each achievable transverse maximum consecutive number Ncc, the combination number CNcc of the arrangements of the first type regions A1 for realizing the transverse maximum consecutive number Ncc is calculated. For example, one transverse line-shaped region is decomposed into a plurality of elements corresponding to the first-type-region-number expected value NcE and the transverse maximum consecutive number Ncc. Corresponding to the decomposition result, the combination number CNcc of the arrangements of NcE pieces of the first type regions A1 for realizing the transverse maximum consecutive number Ncc is calculated.

(4) The transverse consecution expected value NccE is calculated in accordance with the operation expression "NccE=Σ(Ncc*CNcc)/Σ(CNcc)."

The following describes other parameters in Table 2. The transverse-maximum-consecutive-number average value NccA (hereinafter referred to also as a "transverse consecution average value NccA") is the average value of the transverse maximum consecutive numbers Ncc of 12 transverse line-shaped regions. The continuity judgment result denotes the comparison result between the transverse consecution average value NccA and the transverse consecution expected value NccE. The "A grade" denotes "NccA>NccE" and the "B grade" denotes "NccA≤NccE." The A grade of the continuity judgment result means that the actually measured average value NccA of the transverse maximum consecutive number Ncc is larger than the expected value NccE of the transverse maximum consecutive number Ncc. That is, the A grade denotes excellent continuity of the first type region A1 within the transverse line-shaped region. In this case, it is estimated that the current is likely to flow along the transverse line-shaped region.

C-2. Configuration of Resistor Element 70 and Evaluation Result:

As shown in Table 2, the respective continuity judgment results of No. T1 to No. T5 were the A grade, the A grade, the A grade, the A grade, and the B grade. As shown by these samples, the load-life evaluation result was 5 points in the case where the continuity judgment result was the B grade while being 10 points in the case where the continuity judgment result was the A grade. As the reason for this result, it is estimated that this is because the continuity of the first type region A1 within the transverse line-shaped region is excellent in the case where the continuity judgment result is the A grade as described above and thus the current is likely to be dispersed along the transverse line-shaped region.

As described above, in the second judgment test, "Energy Output from Power Source in 1 Cycle" is large compared with the first judgment test. Also under this severe condition, the load-life evaluation result of 10 points was able to be achieved in the case where the continuity judgment result is the A grade, that is, in the case where the transverse consecution average value NccA was larger than the transverse consecution expected value NccE. Thus, the transverse consecution average value NccA is preferred to be larger than the transverse consecution expected value NccE. However, since the second evaluation test was performed under the relatively severe condition, it is estimated that a practicable load life is achieved even when the transverse consecution average value NccA is equal to or less than the transverse consecution expected value NccE.

Here, the respective transverse consecution average values NccA of No. T1 to No. T5 were 7.33, 1.83, 1.75, 2.50, and 2.18. Any value selected from these five values can be adopted as the lower limit of a preferred range (the lower limit or more and the upper limit or less) of the transverse consecution average value NccA. In the five values, any value of the lower limit or more can be adopted as the upper limit. Additionally, in the five values, the transverse consecution average values NccA that can achieve the load-life evaluation result of 10 points were 1.75, 1.83, 2.50, and 7.33. The upper limit and the lower limit in the preferred range of the transverse consecution average value NccA may be selected from these four values. However, since the second evaluation test was performed under the relatively severe condition, it is estimated that a practicable load life can be achieved even when the transverse consecution average value NccA is out of the preferred range.

The respective transverse consecution expected values NccE of No. T1 to No. T5 were 6.2, 1.67, 1.67, 2.21, and 2.21. Any value selected from these five values can be adopted as the lower limit of a preferred range (the lower limit or more and the upper limit or less) of the transverse consecution expected value NccE. In the five values, any value of the lower limit or more can be adopted as the upper limit. Additionally, in the five values, the transverse consecution expected values NccE that can achieve the load-life evaluation result of 10 points were 1.67, 2.21, and 6.2. The upper limit and the lower limit in the preferred range of the transverse consecution expected value NccE may be selected from these three values. However, since the second evaluation test was performed under the relatively severe condition, it is estimated that a practicable load life is achieved even when the transverse consecution expected value NccE is out of the preferred range.

Here, the respective parameters NL1, R, NL2, 300L, and 70D of No. T1 to No. T5 were as described in Table 2. As described above, since the second evaluation test was performed under the relatively severe condition, it is estimated that a practicable load life is achieved in the case where these parameters NL1, R, NL2, 300L, and 70D are different from the values of the above-described samples. In each case, it is estimated that setting at least the first type line number NL1 within the above-described preferred range allows achieving the favorable radio-wave-noise evaluation result (for example, 2 points or more under the condition of the first evaluation test) and the favorable load-life evaluation result (for example, 2 points or more under the condition of the first evaluation test). Here, in addition to the first type line number NL1, the second type line number NL2 is preferred to be set within the above-described preferred range. Additionally, the component ratio R is preferred to be set within the above-described preferred range. Additionally, the resistor element diameter 70D is preferred to be set within the above-described allowable range. Additionally, the connecting portion length 300L is preferred to be set within the above-described allowable range.

D. Modifications:

(1) The material of the resistor element 70 is not limited to the above-described material, and various materials can be adopted. As the glass, for example, glass containing one or more types of $B_2O_3$—$SiO_2$-based, BaO—$B_2O_3$-based, $SiO_2$—$B_2O_3$—CaO—BaO-based, $SiO_2$—ZnO—$B_2O_3$-based, $SiO_2$—$B_2O_3$—$Li_2O$-based, and $SiO_2$—$B_2O_3$—$Li_2O$—BaO-based glasses can be adopted. Additionally, the material that forms the aggregate is not limited to glass, and various ceramic materials such as alumina may be adopted. Alternatively, the mixture (for example, alumina) of glass and ceramic material may be adopted. In each case, the shape of the material particle that forms the aggregate is preferred to be flat. Thus, by applying the force in the direction parallel to the central axis CL to compress the material of the resistor element 70 during manufacture of the resistor element 70, in the flat material particle, the direction of the short axis can be brought close to the direction parallel to the central axis CL and the direction of the long axis can be brought close to the direction perpendicular to the central axis CL. As a result, the zirconia portion P1 (in FIG. 2) that extends in the direction intersecting with the central axis CL can be simply formed. That is, the first type line number NL1 and the second type line number NL2 can be simply increased. Here, the long axis of the flat particle is the axis forming the maximum outer diameter of the particle. The short axis of the flat particle is the axis forming the minimum outer diameter of the particle. To realize the first type line number NL1 within the above-described preferred range, the aspect ratio (the length (maximum outer diameter) of the long axis: the length (minimum outer diameter) of the short axis) of the material particle of the aggregate is preferred within the range of "1:0.4" to "1:0.7."

Here, the line numbers NL1 and NL2 can simply be adjusted by adjusting the aspect ratio of the material particle of the aggregate and the collapsibility of the material particle (in particular, the glass particle) of the aggregate. For example, increasing the length of the long axis with respect to the length of the short axis allows increasing the line numbers NL1 and NL2. Additionally, increasing the collapsibility of the glass particle allows increasing the line numbers NL1 and NL2.

The transverse consecution average value NccA can simply be adjusted by adjusting the aspect ratio of the material particle of the aggregate, the collapsibility of the material particle (in particular, the glass particle) of the aggregate, and the proportion (for example, weight percent) of the material of the filler and the proportion of the conductive material in the material of the resistor element 70. For example, while the length of the long axis with respect to the length of the short axis in the material particle of the aggregate is increased, the proportion of the material of the filler and the proportion of the conductive material are increased. This allows increasing the transverse consecution average value NccA. Additionally, while the collapsibility of the glass particle is increased, the proportion of the material of the filler and the proportion of the conductive material are increased. This allows increasing the transverse consecution average value NccA. Thus, increasing the transverse consecution average value NccA allows achieving the transverse consecution average value NccA larger than the transverse consecution expected value NccE.

(2) The shape of the resistor element 70 is not limited to the approximately cylindrical shape, and any shape can be adopted. For example, the through hole 12 of the insulator 10 may include a portion whose inner diameter changes toward the front end direction D1. The resistor element 70 may be formed in the portion whose inner diameter changes. In this case, the resistor element 70 includes a portion whose outer diameter changes toward the front end direction D1. The radio-wave-noise evaluation result and the load-life evaluation result are estimated to be affected by a portion with a small outer diameter in the resistor element 70. Accordingly, generally, in the cross section perpendicular to the axial line CL in the resistor element 70, the minimum value of the outer diameter of the portion in contact with the inner peripheral surface of the through hole 12 of the insulator 10 over the whole circumference is preferred to be within the above-described preferred range of the resistor element diameter 70D.

In each case, it can be said that when the first type line number NL1 calculated using the target region A10 arranged in at least one position on the cross section including the central axis CL of the resistor element 70 is within the above-described preferred range, the first type line number NL1 of the resistor element 70 is within the preferred range. It is estimated that when the first type line number NL1 of the resistor element 70 is within the preferred range, the suppression performance of the radio wave noise and the service life of the resistor element can be improved. The same applies to the second type line number NL2.

(3) The configuration of the spark plug is not limited to the configuration described in FIG. 1, and various configurations can be adopted. For example, a noble metal tip may be disposed in the portion that forms the gap g in the ground electrode 30. As the material of the noble metal tip, a material containing various noble metals such as iridium and platinum can be adopted. Similarly, a noble metal tip may be disposed in the portion that forms the gap g in the center electrode 20.

The present invention has been described above based on the embodiment and the modifications. The above-described embodiments of the invention are for ease of understanding of the present invention and do not limit the present invention. The present invention may be modified or improved without departing from the gist and the claims of the present invention, and includes the equivalents.

DESCRIPTION OF REFERENCE SIGNS

5 Gasket
6 First rear-end-side packing
7 Second rear-end-side packing
8 Front-end-side packing
9 Talc
10 Insulator (ceramic insulator)
11 Second outer-diameter contracted portion
12 Through hole (shaft hole)
13 Nose portion
14 Rear opening
15 First outer-diameter contracted portion
16 Inner-diameter contracted portion
17 Front-end-side trunk portion
18 Rear-end-side trunk portion
19 Flange portion
20 Center electrode
21 Outer layer
22 Core portion
23 Head
24 Flange portion
25 Nose portion
29 Front end surface
30 Ground electrode
31 Front end portion
35 Base material
36 Core portion
40 Terminal metal fitting
50 Metal shell
51 Tool engagement portion
52 Screw portion
53 Crimp portion
54 Seat portion
55 Trunk portion
56 Inner-diameter contracted portion
58 Deformed portion
59 Through hole
60 First seal portion
70 Resistor element
70D Outer diameter (resistor element diameter)
70L Resistor element length
80 Second seal portion
100 Spark plug
300 Connecting portion
300L Connecting portion length
400 Partial cross section
g Gap
R Component ratio
D1 Front end direction
D1*r* Rear end direction
A1 First type region
A2 Second type region
CL Central axis (axial line)
Ac Conductive region
Nc First type region number
Aa Aggregate region
Pg Portion
P3 Other component portion
P2 Titania portion
P1 Zirconia portion
A10 Target region
L01 to L12 Transverse line-shaped region
La First length
A20 Square region
Lb Second length
NL1 First type line number
NL2 Second type line number
Ncc Transverse maximum consecutive number Having described the invention, the following is claimed:

1. A spark plug, comprising:

an insulator that has a through hole extending in a direction of an axial line;

a center electrode at least partially inserted into a front end side of the through hole;

a terminal metal fitting at least partially inserted into a rear end side of the through hole; and a connecting portion electrically connecting the center electrode and the terminal metal fitting together within the through hole, wherein the connecting portion includes a resistor element, the resistor element includes an aggregate, a filler containing $ZrO_2$, and carbons, and in a cross section including the axial line of the resistor element, when:

a center line is defined by the axial line, a target region is defined by a rectangular region where a size in a direction perpendicular to the axial line is 1800 μm and a size in a direction of the axial line is 2400 μm;

a transverse line-shaped region is defined by a line-shaped region, the line-shaped region being constituted of nine square regions arranged in the direction perpendicular to the axial line in the case where the target region is divided into a plurality of square regions, the square region having a length of 200 μm on a side;

a first type region is defined by the square region where a proportion of an area of $ZrO_2$ is 25% or more; and a second type region is defined by the square region where a proportion of an area of $ZrO_2$ is less than 25%, a total number of the transverse line-shaped regions including two or more of the first type regions is equal to or more than 5.

2. The spark plug according to claim 1, wherein a total number of the transverse line-shaped regions including two or more of the consecutive first type regions is equal to or more than 5.

3. The spark plug according to claim 1, wherein the filler contains $TiO_2$, and a weight proportion of Ti to Zr in the resistor element is equal to or more than 0.05 and equal to or less than 6.

4. The spark plug according to claim 1, wherein in a cross section pernendicular to the axial line in the resistor element, a minimum value of an outer diameter of a portion in contact with an inner peripheral surface of the insulator over a whole circumference is equal to or less than 3.5 mm.

5. The spark plug according to claim 4, wherein the minimum value of the outer diameter is equal to or less than 2.9 mm.

6. The spark plug according to claim 1, wherein a distance in the axial line between a rear end of the center electrode and a front end of the terminal metal fitting is equal to or more than 15 mm.

7. The spark plug according to claim 1, wherein when: a longitudinal line-shaped region is defined by a line-shaped region that is constituted of 12 of the square regions arranged in a direction parallel to the axial line; and a longitudinal maximum consecutive number is defined by a maximum value of a consecutive number of the first type regions in one longitudinal line-shaped region, an average value of the longitudinal maximum consecutive number in nine longitudinal line-shaped regions included in the target region is equal to or less than 5.0.

8. The spark plug according to claim 1, wherein a total number of the transverse line-shaped regions including two or more of the consecutive first type regions is equal to or more than 7.

9. The spark plug according to claim 1, wherein when a transverse maximum consecutive number is defined by a maximum value of a consecutive number of the first type regions in one transverse line-shaped region, an average value of the transverse maximum consecutive number in 12 transverse line-shaped regions included in the target region is larger than an expected value of the transverse maximum consecutive number calculated from a total number of the first type regions in the target region.

* * * * *